US011387538B2

(12) United States Patent
Liu et al.

(10) Patent No.: US 11,387,538 B2
(45) Date of Patent: Jul. 12, 2022

(54) ANTENNA MOUNTING DEVICE

(71) Applicant: CommScope Technologies LLC, Hickory, NC (US)

(72) Inventors: Maosheng Liu, Jiangsu (CN); Ruixin Su, Jiangsu (CN); ZhaoHui Liu, Jiangsu (CN); PuLiang Tang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 194 days.

(21) Appl. No.: 16/830,875

(22) Filed: Mar. 26, 2020

(65) Prior Publication Data

US 2020/0321679 A1 Oct. 8, 2020

(30) Foreign Application Priority Data

Apr. 8, 2019 (CN) ..... 201910275486.2

(51) Int. Cl.
*H01Q 1/12* (2006.01)
*H01Q 1/24* (2006.01)

(52) U.S. Cl.
CPC ..... *H01Q 1/1228* (2013.01); *H01Q 1/246* (2013.01)

(58) Field of Classification Search
CPC combination set(s) only.
See application file for complete search history.

(56) References Cited

U.S. PATENT DOCUMENTS 6,111,553 A * 8/2000 Steenbuck ..... H01Q 1/1207 343/891
6,222,504 B1 * 4/2001 Oby ..... H01Q 1/1228 343/890
7,106,273 B1 * 9/2006 Brunson ..... H01Q 1/246 343/890
2015/0144758 A1 * 5/2015 Kolokotronis ..... H01Q 1/1242 248/282.1
2016/0240910 A1 * 8/2016 Balter ..... H01Q 1/246
2016/0365624 A1 * 12/2016 Maley ..... H01Q 1/1228
2019/0058239 A1 * 2/2019 Smith ..... H01Q 1/1242
2019/0348752 A1 * 11/2019 Kim ..... H01Q 1/42
2021/0265725 A1 * 8/2021 Clifford ..... H01Q 1/1228

* cited by examiner

*Primary Examiner* — Junpeng Chen
(74) *Attorney, Agent, or Firm* — Myers Bigel, P.A.

(57) ABSTRACT

The present invention relates to an antenna mounting device configured to collectively mount a plurality of base station antennas on the same pole. The antenna mounting device comprises: a bracket (1) defining a central recess (4) in a mounted state, the central recess being configured such that the central recess (4) loosely receives the pole (3); a fastening device (2) configured to fasten the bracket (1) to the pole (3); and a plurality of connecting members (5), each of the connecting members being configured for connection with at least one of the plurality of base station antennas (6), and the connecting members having a predetermined relative position on the bracket. With such an antenna mounting device, the plurality of base station antennas can be mounted on the same pole at precise positions relative to each other.

20 Claims, 5 Drawing Sheets

ANTENNA MOUNTING DEVICE

RELATED APPLICATION

The present application claims priority from and the benefit of Chinese Patent Application No. 201910275486.2, filed Apr. 8, 2019, the disclosure of which is hereby incorporated herein in its entirety.

FIELD OF THE INVENTION

The present invention relates generally to the field of base station antennas. More particularly, the present invention relates to an antenna mounting device configured to collectively mount a plurality of base station antennas on the same pole.

BACKGROUND OF THE INVENTION

In a mobile communication network, base station antennas need to be configured properly according to actual conditions such as the requirements for coverage of network, the distribution of traffic, the requirements for interference resistance and the like. In some applications, it is required to mount three or more base station antennas around the same pole in a communication tower.

FIG. 1 describes an antenna mounting device in the prior art, comprising two half rings R1, R2 which collectively enclose a pole, such as a monopole, and are fixed to each other at their ends such that the two half rings firmly clamp and are thus fixed to the pole. A plurality of connecting elements C1, C2, C3 may be fixed to the two half rings R1, R2, and are each configured for connection with a base station antenna. In order to ensure the two half rings to be clamped onto the pole, gaps are reserved between the ends of the two half rings. During the mounting process, it is difficult to ensure the uniformity of the two gaps S. Due to the non-uniformity of the two gaps S and the deformation of the two half rings R1, R2 during the clamping process, the actual positions of the connecting elements C1, C2, C3 relative to one another often deviate from their predetermined ideal relative positions. Thus, there is an undesired deviation of the actual positions of the base station antennas relative to each other from the predetermined ideal relative positions.

SUMMARY OF INVENTION

An object of the present invention is to provide an antenna mounting device for collectively mounting a plurality of base station antennas on the same pole, capable of achieving precise relative positions of the base station antennas.

According to an aspect of the present invention, the above-mentioned object is achieved by an antenna mounting device configured to collectively mount a plurality of base station antennas on the same pole, the antenna mounting device comprising:

a bracket defining a central recess in a mounted state, the central recess being configured such that the central recess loosely receives the pole;

a fastening device configured to fasten the bracket to the pole; and a plurality of connecting members, each of the connecting members being configured for connection with at least one of the plurality of base station antennas, and the connecting members having a predetermined relative position on the bracket.

According to another aspect of the present invention, an antenna mounting device is provided, which is configured to collectively mount a plurality of base station antennas on a pole, wherein the antenna mounting device comprises:

a bracket defining a central recess, the central recess being configured to loosely receives the pole;

a fastening device attached to the bracket and configured to secure the bracket to the pole, the pole being located within the central recess; and a plurality of connecting members, each of the connecting members being configured for connection with at least one of the plurality of base station antennas, each of the connecting members mounted to the bracket;

wherein the fastening device includes at least one fastening assembly, which is mounted to respective one of the connecting members such that the position of the at least one fastening assembly can be adjusted relative to the respective connecting member, which adjustment of the position of the at least one fastening assembly causes the fastening device to engage the pole and secure the antenna mounting device to the pole.

In some embodiments, the bracket may include a bracket plate.

In some embodiments, the bracket may include an upper bracket plate and a lower bracket plate, the bracket plates may each have a central recess, and the central recesses of the bracket plates collectively define the central recess of the bracket.

In some embodiments, the upper bracket plate and the lower bracket plate may be an integrally-connected component or two separate components.

In some embodiments, the central recesses of the upper and the lower bracket plate may each have a lateral opening, which may be configured to allow the pole to pass through.

In some embodiments, the bracket may include a plurality of bracket plates that may be connected to each other directly or indirectly in a circumferential direction.

In some embodiments, the connecting members may be fixed to the bracket as separate components.

In some embodiments, the bracket may have a plurality of prefabricated holes, and the connecting members are fixed to the bracket by means of fastening elements passing through the individual holes.

In some embodiments, a single connecting member may be constructed as a U-shaped component having a bottom limb and two side limbs.

In some embodiments, the U-shaped component may have a connecting element extending from the bottom limb in a direction away from the two side limbs and configured to be connected to the at least one base station antenna.

In some embodiments, the fastening device may include a plurality of separate fastening assemblies.

In some embodiments, the fastening device may be constructed similarly to the two half rings shown in FIG. 1, in which the bracket is connected to two half rings.

In some embodiments, a single fastening assembly may include an engagement element, and a pressing element configured to press the engagement element against the pole.

In some embodiments, the engagement element may be constructed as a U-shaped component having a bottom limb and two side limbs.

In some embodiments, each of the side limbs may have an engagement segment for engaging the pole.

In some embodiments, the pressing element is capable of acting on the bottom limb.

In some embodiments, the engagement element may have a guide element configured to guide the engagement element during movement of the engagement element.

In some embodiments, the pressing element may be a screw.

In some embodiments, the engagement element may have a recess for receiving a free end of the screw.

In some embodiments, the fastening device may include a plurality of separate fastening assemblies, and a single fastening assembly and a single connecting member may constitute a structural unit.

In some embodiments, the fastening assembly may be received between the two side limbs of the connecting member in a non-lost manner.

In some embodiments, the fastening assembly may include an engagement element, and a pressing element configured to press the engagement element against the pole, wherein the engagement element may be configured as a second U-shaped component having a bottom limb and two side limbs, each side limb of the engagement element has an engagement segment for engaging the pole, and the pressing element is capable of acting on the bottom limb of the engagement element.

In some embodiments, the engagement element may have a guide element, the connecting member may have a corresponding guide element, and the guide element and the corresponding guide element may cooperate with each other to guide the engagement element during movement of the engagement element.

In some embodiments, the guide element may be a plurality of finger elements that are parallel to each other, and the corresponding guide element may be a plurality of holes.

In some embodiments, the pressing element may be a screw, and the connecting member may be provided with a threaded hole, in which the screw may be received.

In some embodiments, the antenna mounting device may be configured to collectively mount three, four or more base station antennas on the same pole.

In some embodiments, each of the connecting members may include a fastening assembly mounted thereto, wherein each of the fastening assemblies is mounted to the respective connecting member such that the positions of the fastening assemblies can be adjusted relative to the respective connecting members, whereby each of the fastening assemblies can engage the pole.

In some embodiments, the at least one fastening assembly and respective connecting member may be configured such that the at least one fastening assembly can move relative to the respective connecting member in a direction towards the pole and away from the pole.

The technical features mentioned above and those to be described below may be arbitrarily combined with each other as long as it is technically meaningful.

BRIEF DESCRIPTION OF THE DRAWINGS

The present invention will be explained in more detail below by specific embodiments with reference to the accompanying drawings. The schematic drawings are briefly described as follows.

EMBODIMENTS

Figure 1:
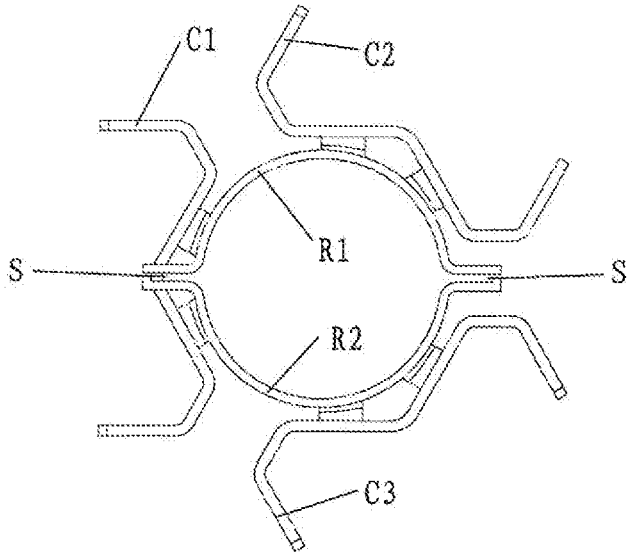
FIG. 1 is a schematic plan view of an antenna mounting device for base station antennas in the prior art.
Figure 2:
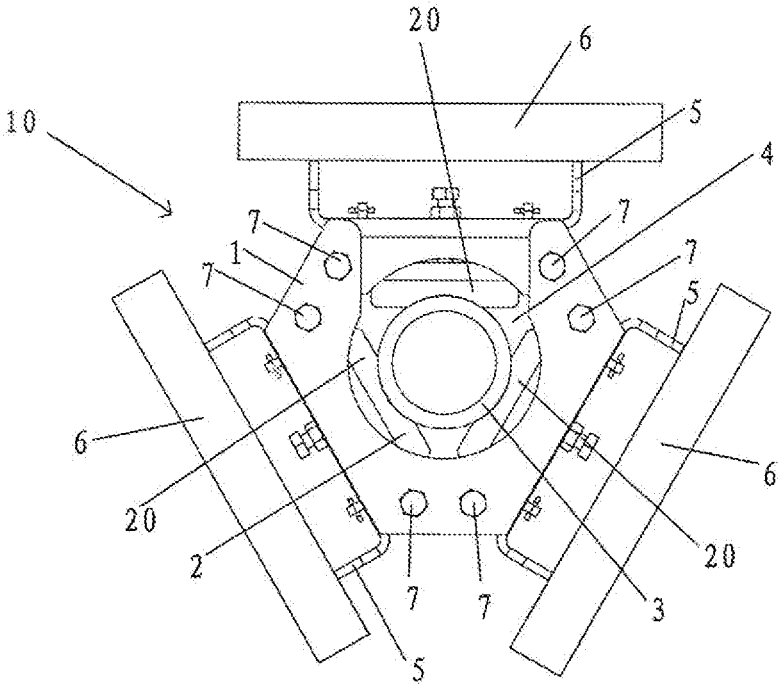
FIG. 2 is a schematic plan view of an antenna mounting device in a mounted state according to an embodiment of the present invention.

FIG. 2 is a schematic plan view of an antenna mounting device 10 in a mounted state according to an embodiment of the present invention, and FIGS. 3A to 3D are schematic perspective views for describing a mounting process of the antenna mounting device according to FIG. 2.

As shown in FIG. 2, the antenna mounting device 10 is configured to collectively mount three base station antennas 6 on the same pole 3, in which the base station antennas 6 are only schematically represented. The antenna mounting device comprises a bracket 1 defining a central recess 4 that loosely receives the pole 3. In other words, the central recess 4 is sized to be greater than the pole 3 so that the bracket 1 is capable of performing limited movement relative to the pole 3 in the radial direction of the pole. The pole 3 generally has a circular cross-section.

In the embodiment shown in FIG. 2 and FIGS. 3A to 3D, the bracket 1 comprises an upper bracket plate 11 and a lower bracket plate 12 having central recesses 4*a*, 4*b* respectively that collectively define the central recess 4 of the bracket. The central recesses 4*a*, 4*b* each have a lateral opening 4*c*, 4*d*, which is configured to allow the pole 3 to pass through. The bracket plate 11 and the bracket plate 12 may be constructed in the same manner. A plurality of connecting members 5 are disposed between and fixedly connected to the bracket plates 11 and 12. The bracket plates 11, 12 and the connecting members 5 may each be provided with a plurality of prefabricated holes, in which corresponding fastening elements 7 are received for fixedly connecting the connecting members 5 to the bracket plates 11, 12. The lateral openings 4*c*, 4*d* may be closed by one of the connecting members 5. By means of the prefabricated holes in the bracket, the positions of the connecting members 5 relative to each other on the bracket 1 can be predetermined more accurately.

The mounting process of the antenna mounting device according to FIG. 2 will now be described with reference to FIGS. 3A to 3D.

Figure 3A:
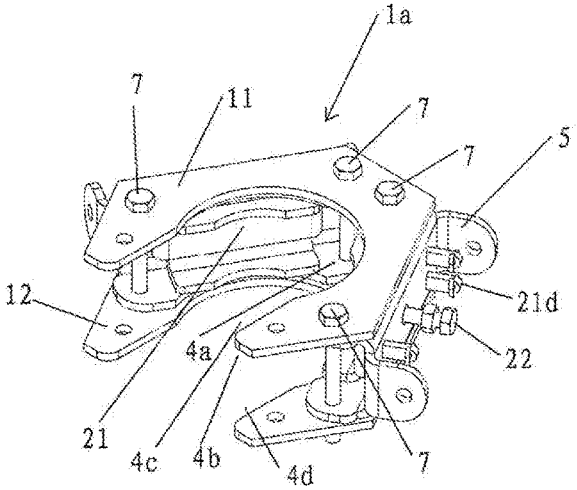
FIGS. 3A to 3D are schematic perspective views for describing a mounting process of the antenna mounting device according to FIG. 2.
Figure 3B:
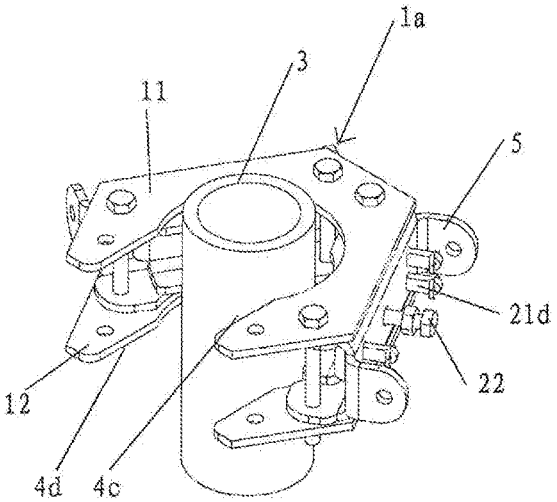
Figure 3C:
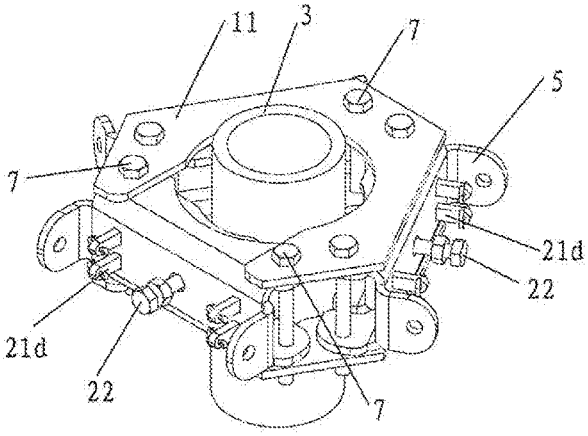
Figure 3D:
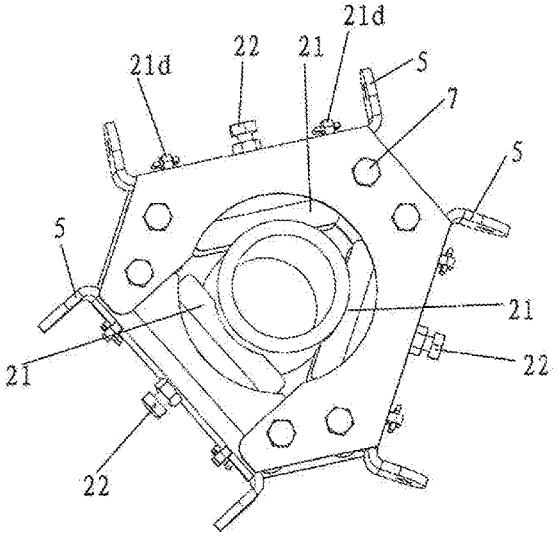

First, as shown in FIG. 3A, the bracket plates 11, 12 and two connecting members 5 may be pre-assembled into a pre-assembled unit 1*a* having a lateral opening defined by the lateral openings 4*c*, 4*d* of the bracket plates 11, 12. Then, as shown in FIG. 3B, the pre-assembled unit 1*a* is fitted onto the pole 3 through its lateral opening until the pole 3 is located within the central recess 4 of the pre-assembled unit 1*a*. Thereafter, as shown in FIG. 3C, an additional connecting member 5 is connected to the pre-assembled unit, wherein this connecting member 5 closes the lateral opening of the pre-assembled unit 1*a*. Finally, a fastening device 2 is tensioned so that the bracket 1 is firmly fixed to the pole 3.

Figure 4A:
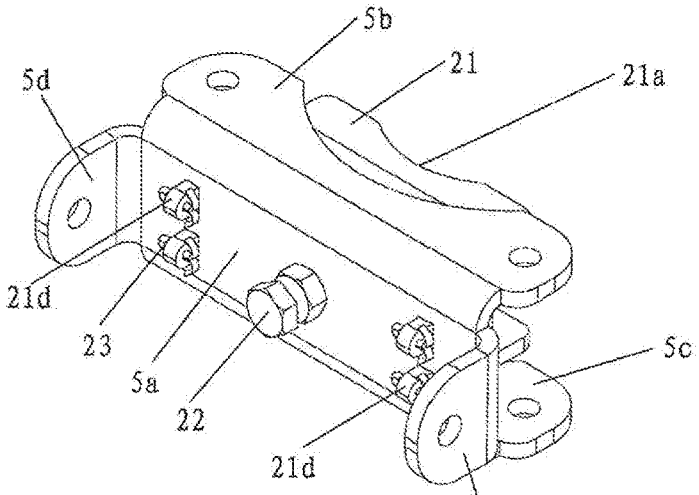
FIG. 4A is a schematic perspective view of a structural unit of the antenna mounting device, which unit includes a single connecting member and a single fastening assembly.
Figure 4B:
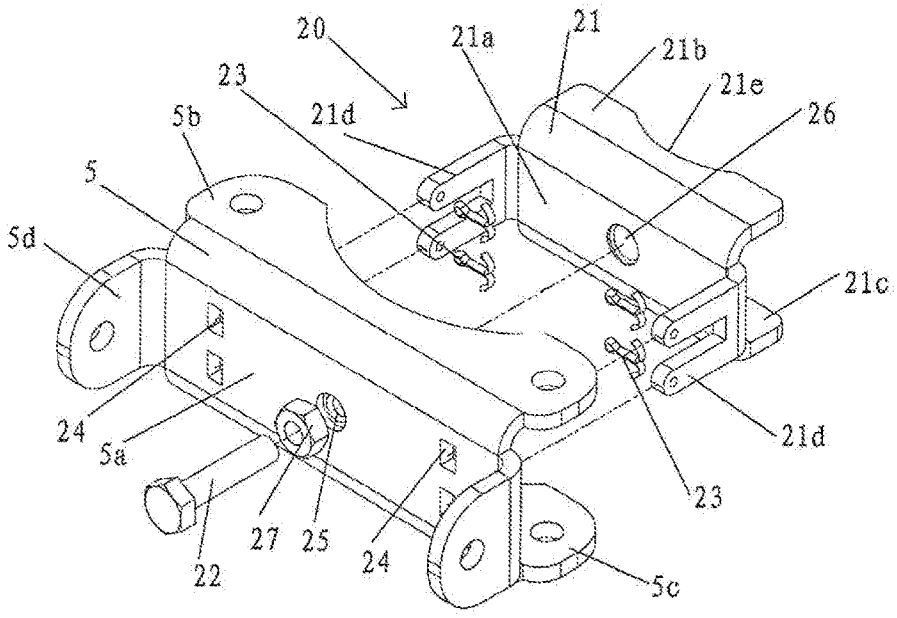
FIG. 4B is an exploded view of the structural unit according to FIG. 4A.
Figure 4C:
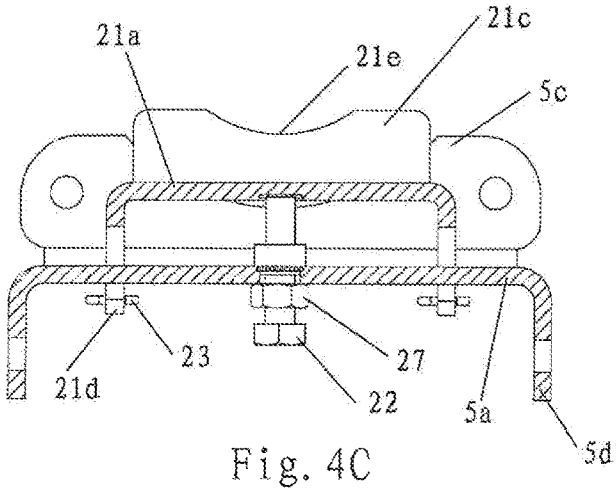
FIG. 4C is a longitudinal sectional view of the structural unit according to FIG. 4A.

Next, some embodiments of the connecting members 5 and the fastening device 2 will be described with reference to FIGS. 4A to 4C. FIG. 4A is a schematic perspective view of a structural unit of the antenna mounting device, which unit includes a single connecting member 5 and a single fastening assembly 20; FIG. 4B is an exploded view of the structural unit according to FIG. 4A; and FIG. 4C is a longitudinal sectional view of the structural unit according to FIG. 4A.

The single connecting member 5 may be constructed as a U-shaped component having a bottom limb 5*a* and two side limbs 5*b*, 5*c*. The two side limbs 5*b*, 5*c* may each have two prefabricated holes for receiving fastening elements 7. The U-shaped component may have connecting elements 5*d* which extend from the bottom limb 5*a* in a direction away from the two side limbs 5*b*, 5*c* and are configured to be connected with the base station antenna.

The connecting member 5 may be constructed as a receiving and guiding device for the fastening assembly 20. The fastening assembly 20 may be received in the connecting member 5, and more specifically, may be received between the two side limbs 5*b*, 5*c* of the connecting member 5.

The fastening assembly 20 may include an engagement element 21, and a pressing element 22 configured to press the engagement element 21 against the pole 3. The engagement element 21 may be constructed as a U-shaped component having a bottom limb 21*a* and two side limbs 21*b*, 21*c*, wherein each of the side limbs 21*b*, 21*c* may have an engagement segment 21*e* for engaging the pole 3, and the pressing element 22 is capable of acting on the bottom limb 21*a*. The engagement element 21 may have guide elements 21*d*, the connecting member 5 may have counter guide elements 24, and the guide elements 21*d* and the counter guide elements 24 may cooperate with each other for guiding the engagement element 21 during movement of the engagement element 21. The guide elements 21*d* may be finger elements and the counter guide elements 24 may be holes. The engagement element 21 may be retained on the connecting member 5 by latches 23 without being lost.

In other embodiments, the guide elements 21*d* may be holes and the counter guide elements 24 may be finger elements. In this case, the counter guide elements 24 may extend from the bottom limb 5*a* towards the engagement element 21, and the guide elements 21*d* may be provided in the bottom limb 21*a* of the engagement element 21.

The pressing element 22 may be a screw, and the connecting member 5 may be provided with a threaded hole 25, in which the screw 22 may be received. The engagement element 21 may have a recess 26 for receiving a free end of the screw 22. While the screw 22 is being screwed into the threaded hole 25, the engagement element 21 will be pushed towards the holding role 3, so that the engaging element 21 is pressed against the pole 3. While the screw 22 is being screwed out of the threaded hole 25, the engagement element 21 will be released, so that the engaging element 21 can be released relative to the pole 3. Further, a locknut 27 may be provided for preventing the screw 22 from being unintentionally released in the fastened state.

In the embodiment shown, the connecting member 5 and the fastening assembly 20 collectively constitute a structural unit. However, it may also be considered that the connecting member 5 and the fastening assembly 20 may be configured as separate units, for example, they may be mounted in the bracket 1 adjacent to each other in a circumferential direction of the bracket 1.

In principle, three fastening assemblies 20 can enable the fastening of the bracket 1 to the pole 3. When the number of the connecting members 5 is more than three, at least one of the connecting members 5 may be free of the fastening assembly 20.

In the embodiment shown, the connecting member 5 and the bracket 1 are separate components and connected to each other by the fastening elements 7. However, it may also be considered that the connecting member 5 may be an integral component of the bracket 1; alternatively, the connecting member 5 and the bracket 1 are separate components and are then formed as an integral component by means of welding.

Figure 5:
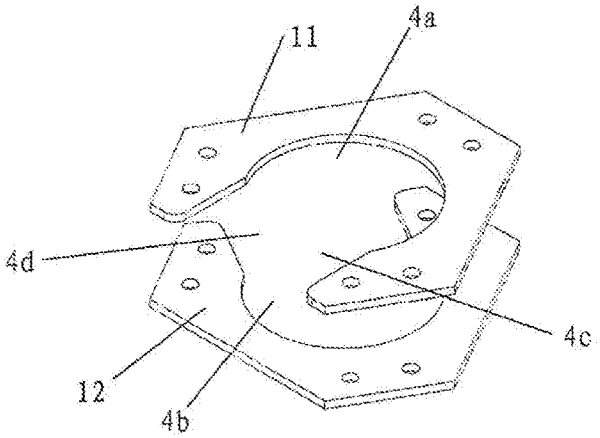
FIG. 5 is a schematic perspective view of bracket plates of an antenna mounting device according to another embodiment.

FIG. 5 is a schematic perspective view of bracket plates of an antenna mounting device according to another embodiment. FIG. 5 only describes two bracket plates 11, 12 of the antenna mounting device, whereas the other components of the antenna mounting device may be constructed as or differently from those shown in the embodiment of FIG. 2. The upper bracket plate 11 and the lower bracket plate 12 may be constructed in the same way. In a mounted state of the antenna mounting device, the upper bracket plate 11 may be turned, for example, by 120°, relative to the lower bracket plate 12.

Figure 6:
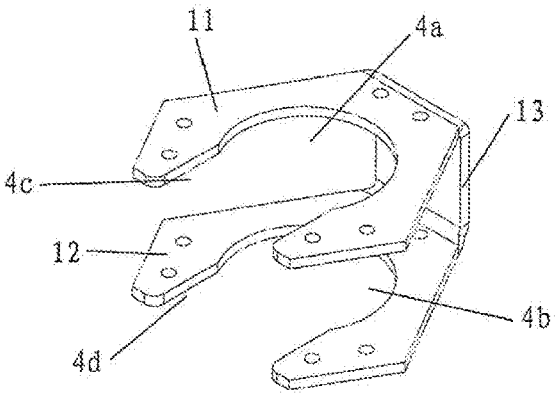
FIG. 6 is a schematic perspective view of bracket plates of an antenna mounting device according to a further embodiment.

FIG. 6 is a schematic perspective view of bracket plates of an antenna mounting device according to a further embodiment. FIG. 6 only describes two bracket plates 11, 12 of the antenna mounting device that are connected into one piece by a connecting plate 13, whereas the other components of the antenna mounting device may be constructed as or differently from those shown in the embodiment of FIG. 2. The bracket plates 11, 12 and the connecting plate 13 may be pressed from a single sheet metal.

Figure 7:
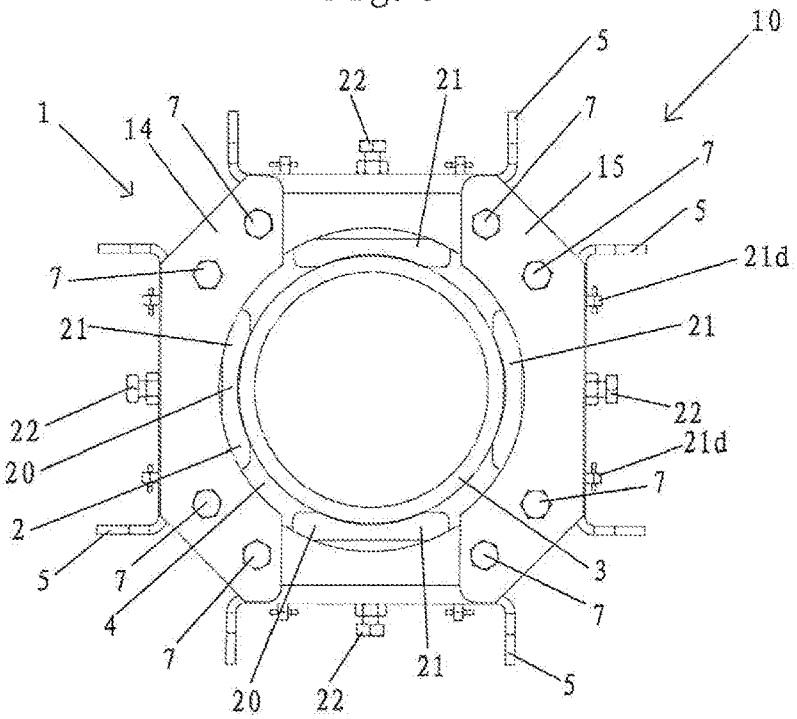
FIG. 7 is a schematic plan view of an antenna mounting device in a mounted state according to another embodiment of the present invention.

FIG. 7 is a schematic plan view of an antenna mounting device 10 in a mounted state according to another embodiment of the present invention. The antenna mounting device is configured to collectively mount four base station antennas (not shown) onto the same pole 3. The antenna mounting device comprises a bracket 1 which, in the mounted state, defines a central recess 4 loosely receiving the pole 3 such that the bracket 1 is capable of performing limited movement in the radial direction of the pole when the fastening device 2 is released.

In the embodiment shown in FIG. 7, the antenna mounting device has four connecting members 5, and four fastening assemblies 20 that combine to form the fastening device 2. These connecting members 5 are spaced apart from each other on the bracket 1 by an angular spacing of 90°.

In the embodiment shown in FIG. 7, the bracket 1 has two bracket plates 14, 15 on two sides of the pole 3 respectively, wherein the two bracket plates 14 on one side of the pole 3, i.e., an upper bracket plate and a lower bracket plate (not visible in FIG. 7), may be constructed as two separate components or connected into an integral component, and the two bracket plates 15 on the other side of the pole 3, i.e. an upper bracket plate and a lower bracket plate (not visible in FIG. 7), may also be constructed as two separate components or connected into an integral component. The bracket plates 14 and the bracket plates 15 may be connected indirectly at both ends thereof via the connecting member 5. In some embodiments not shown, the bracket plates 14 and the bracket plates 15 may also be connected directly at their respective ends. The connecting members 5 may be mounted between the two upper bracket plates 14, 15 and the two lower bracket plates 14, 15. The bracket plates 14, 15 and the connecting members 5 may each be provided with a plurality of prefabricated holes, in which corresponding fastening elements 7 are received for fixedly connecting the connecting members 5 to the bracket plates 14, 15. By means of the prefabricated holes in the bracket plates, the positions of the connecting members 5 relative to each other on the bracket 1 can be predetermined more accurately. In the embodiment shown in FIG. 7, the connecting members 5 and the fastening device 2 may be constructed as, similarly to or differently from those shown in the embodiment of FIG. 2.

In the embodiment shown, a single connecting member 5 is configured for connection with one base station antenna. However, it may also be considered that a single connecting member 5 may be configured for connection with a plurality of base station antennas, for example, small cell base station antennas. In the case where the base station antennas have a large height, two or more antenna mounting devices may be sequentially disposed on the pole in its height direction, and each base station antenna may be fixed to the pole by a respective one connecting member of each antenna mounting device.

Figure 8:
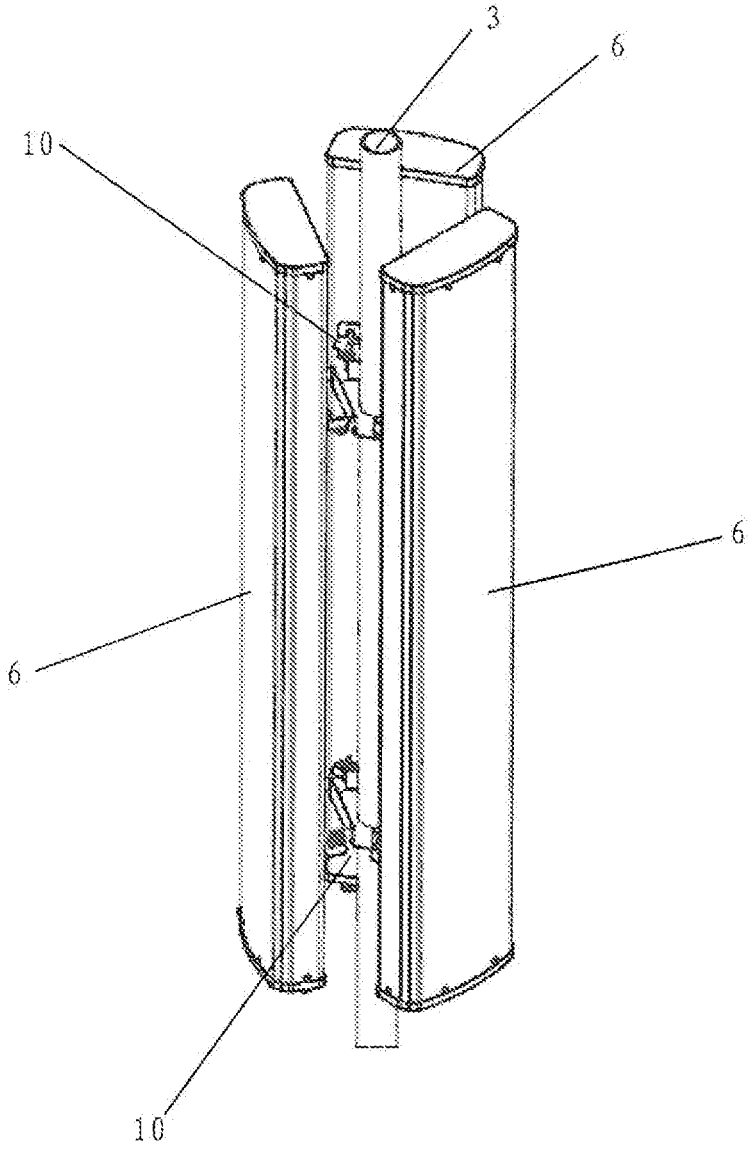
FIG. 8 is a schematic perspective view of a base station antenna system in accordance with an embodiment of the present invention.

FIG. 8 is a schematic perspective view of a base station antenna system, in which a plurality of base station antennas 6 are mounted onto the pole 3 via an upper and a lower antenna mounting device 10. These antenna mounting devices may be constructed in accordance with the aforementioned embodiments.

In comparison to the prior art antenna mounting devices, the antenna mounting device according to the present invention can be easily and firmly mounted on the pole, and can ensure a precise relative position of the base station antennas. Besides, through the adjustable fastening device, the relative position of the antenna mounting device with respect to the pole can be adjusted easily and finely.

In the present application, the terms "upper", "lower" and "lateral" are defined with reference to a vertically-oriented pole. The pole may also be oriented obliquely or horizontally, wherein the above-described terms shall be understood in a relative sense.

It will be understood that, the terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprise" and "include" (and variants thereof), when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween. In contrast, terms such as "directly on," "directly coupled to" and "directly connected to," when used herein, indicate that no intervening elements are present. Other words used to describe the relationship between elements should be interpreted in a like fashion (i.e., "between" versus "directly between", "attached" versus "directly attached," "adjacent" versus "directly adjacent", etc.).

Terms such as "top," "bottom," "upper," "lower," "above," "below," and the like are used herein to describe the relationship of one element, layer or region to another element, layer or region as illustrated in the figures. It will be understood that these terms are intended to encompass different orientations of the device in addition to the orientation depicted in the figures.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

It will also be appreciated that all example embodiments disclosed herein can be combined in any way.

Finally, it is to be noted that, the above-described embodiments are merely for understanding the present invention but not constitute limits on the protection scope of the present invention. For those skilled in the art, modifications may be made on the basis of the above-described embodiments, and these modifications do not depart from the protection scope of the present invention.

What is claimed is:

1. An antenna mounting device, configured to collectively mount a plurality of base station antennas on the same pole, characterized in that the antenna mounting device comprises:

a bracket (1) including an upper bracket plate (11) and a lower bracket plate (12) defining a central recess (4) in a mounted state, the central recess being configured such that the central recess (4) loosely receives the pole (3);

a fastening device (2) configured to fasten the bracket (1) to the pole (3); and a plurality of connecting members (5) disposed between and fixedly connected to the bracket plates, each of the connecting members being configured for connection with at least one of the plurality of base station antennas (6), the connecting members having a predetermined relative position on the bracket.

2. The antenna mounting device according to claim 1, wherein the bracket plates each have a central recess, and the central recesses of the bracket plates collectively defining the central recess (4) of the bracket.

3. The antenna mounting device according to claim 2, wherein the upper bracket plate (11) and the lower bracket plate (12) are an integrally-connected component or two separate components.

4. The antenna mounting device according to claim 2, wherein the central recesses of the upper bracket plate (11) and the lower bracket plate (12) each have a lateral opening configured to allow the pole (3) to pass through.

5. The antenna mounting device according to claim 1, wherein the bracket (1) includes a plurality of bracket plates (14, 15) that are connected to each other directly or indirectly in a circumferential direction.

6. The antenna mounting device according to claim 1, wherein the connecting members (5) are fixed to the bracket as separate components.

7. The antenna mounting device according to claim 6, wherein the bracket (1) has a plurality of prefabricated holes, and the connecting members (5) are fixed to the bracket (1) by means of fastening elements (7) passing through the holes.

8. The antenna mounting device according to claim 6, wherein the single connecting member (5) is constructed as a U-shaped component having a bottom limb (5*a*) and two side limbs (5*b*, 5*c*).

9. The antenna mounting device according to claim 8, wherein the U-shaped component has a connecting element (5*d*) which extends from the bottom limb (5*a*) in a direction away from the two side limbs (5*b*, 5*c*) and is configured to be connected with the at least one base station antenna.

10. The antenna mounting device according to claim 8, wherein the fastening device (2) includes a plurality of separate fastening assemblies (20), and the single fastening assembly (20) and the single connecting member constitute a structural unit.

11. The antenna mounting device according to claim 1, wherein the fastening device (2) comprises a plurality of separate fastening assemblies (20).

12. The antenna mounting device according to claim 11, wherein the single fastening assembly (20) includes an engagement element (21), and a pressing element (22) configured to press the engagement element (21) against the pole (3).

13. The antenna mounting device according to claim 12, wherein the engagement element (21) is constructed as a U-shaped component having a bottom limb (21*a*) and two side limbs (21*b*, 21*c*), each of the side limbs having an engagement section (21*e*) for engagement with the pole (3), and the pressing element (22) being capable of acting on the bottom limb (21*a*).

14. The antenna mounting device according to claim 12, wherein the engagement element (21) has a guide element (21*d*) configured to guide the engagement element (21) during movement of the engagement element (21).

15. The antenna mounting device according to claim 12, wherein the pressing element (22) is a screw.

16. The antenna mounting device according to claim 15, wherein the engagement element (21) has a recess (26) for receiving a free end of the screw.

17. An antenna mounting device, configured to collectively mount a plurality of base station antennas on a pole, characterized in that the antenna mounting device comprises:

a bracket (1) including an upper bracket plate (11) and a lower bracket plate (12) defining a central recess (4), the central recess being configured to loosely receives the pole (3);

a fastening device (2) attached to the bracket and configured to secure the bracket (1) to the pole (3), the pole being located within the central recess; and a plurality of connecting members (5) disposed between and fixedly connected to the bracket plates, each of the connecting members being configured for connection with at least one of the plurality of base station antennas (6), each of the connecting members mounted to the bracket;

wherein the fastening device includes at least one fastening assembly (20), which is mounted to respective one of the connecting members such that the position of the at least one fastening assembly (20) can be adjusted relative to the respective connecting member, which adjustment of the position of the at least one fastening assembly (20) causes the fastening device to engage the pole and secure the antenna mounting device to the pole.

18. The antenna mounting device of claim 17, wherein each of the connecting members (5) includes a fastening assembly (20) mounted thereto, wherein each of the fastening assemblies is mounted to the respective connecting member such that the positions of the fastening assemblies (20) can be adjusted relative to the respective connecting members (5), whereby each of the fastening assemblies can engage the pole.

19. The antenna mounting device of claim 17, wherein the at least one fastening assembly (20) and respective connecting member (5) are configured such that the at least one fastening assembly can move relative to the respective connecting member in a direction towards the pole and away from the pole.

20. An antenna mounting assembly, a mounting pole (3);

a plurality of base station antennas (6); and an antenna mounting device, the antenna mounting device comprising:

a bracket (1) including an upper bracket plate (11) and a lower bracket plate (12) defining a central recess (4) in a mounted state, the central recess being configured such that the central recess (4) loosely receives the mounting pole (3);

a fastening device (2) configured to fasten the bracket (1) to the mounting pole (3); and a plurality of connecting members (5) disposed between and fixedly connected to the bracket plates, the connecting members having a predetermined relative position on the bracket, wherein the antenna mounting device is secured to the mounting pole (3), and wherein at least one of the plurality of base station antennas (6) is secured directly to a respective connecting member (5).

* * * * *